US008460555B2

(12) United States Patent
Yuan

(10) Patent No.: US 8,460,555 B2
(45) Date of Patent: Jun. 11, 2013

(54) CENTRALIZED SUMP OIL AND ACID OIL TREATMENT PROCESS AND SYSTEM

(76) Inventor: Gang Yuan, Hebei Province (CN)

( * ) Notice: Subject to any disclaimer, the term of this patent is extended or adjusted under 35 U.S.C. 154(b) by 1 day.

(21) Appl. No.: 12/822,186

(22) Filed: Jun. 24, 2010

(65) Prior Publication Data

US 2012/0103914 A1 May 3, 2012

(51) Int. Cl.

| | |
|---|---|
| ***C02F 1/02*** | (2006.01) |
| ***C02F 1/04*** | (2006.01) |
| ***C02F 1/24*** | (2006.01) |
| ***C02F 1/28*** | (2006.01) |
| ***C02F 1/40*** | (2006.01) |
| ***C02F 1/52*** | (2006.01) |
| ***C02F 1/66*** | (2006.01) |
| ***B01D 3/10*** | (2006.01) |
| ***B01D 17/035*** | (2006.01) |
| ***B01D 17/05*** | (2006.01) |

(52) U.S. Cl.

USPC ..... 210/703; 210/704; 210/707; 210/804; 210/806; 210/724; 210/799; 210/202; 210/205; 210/206; 210/221.2; 210/266; 210/259; 203/10; 203/11; 588/252; 588/257

(58) Field of Classification Search

USPC ..... 210/703, 704, 705, 706, 707, 806, 210/804, 807, 808, 799, 202, 205, 206, 221.2, 210/266, 259, 724; 203/10, 11; 588/252, 588/257

See application file for complete search history.

(56) References Cited

U.S. PATENT DOCUMENTS

| | | | | |
|---|---|---|---|---|
| 5,006,239 | A * | 4/1991 | Mishra | 210/181 |
| 5,009,767 | A * | 4/1991 | Bartilucci et al. | 208/85 |
| 5,092,998 | A * | 3/1992 | Satoh | 210/257.1 |
| 5,120,435 | A * | 6/1992 | Fink | 210/192 |
| 5,147,534 | A * | 9/1992 | Rymal, Jr. | 210/104 |
| 5,269,906 | A * | 12/1993 | Reynolds et al. | 208/13 |
| 5,302,294 | A * | 4/1994 | Schubert et al. | 210/702 |
| 5,433,863 | A * | 7/1995 | Braden et al. | 210/708 |
| 5,552,498 | A * | 9/1996 | Braden | 526/73 |
| 5,643,460 | A * | 7/1997 | Marble et al. | 210/705 |
| 5,958,240 | A * | 9/1999 | Hoel | 210/608 |

* cited by examiner

*Primary Examiner* — Thomas M Lithgow

(57) ABSTRACT

This invention reveals to the public the centralized sump oil and acid oil treatment process and system. The process consist of (1) the filter; (2) entry to reaction kettle, the sodium carbonate solution added at the time of air floatation till PH value keeps about 6.0-8.0; and emulsion splitter and flocculating agent added for further reaction; (3) suspension of air floatation and static settlement; (4) the international crude oil is collected after the detergent oil at the upper level of the reaction kettle is dehydrated under normal and reduced pressure; the wastewater is drained after filtering by the natural oil removal tank and the oil-water filter; the sludge is solidified by the cement and the quick lime and aluminium oxide are used as the coagulant aid for solidifying the sludge. The centralized treatment process of sump oil and acid oil not only greatly lowers the pollution of surroundings of the oilfield and corrosion of equipment, but also changes waste into valuable, reuses a great amount of crude oil and improves the economic benefits of the oilfield. The sludge solidified can be directly used for buildings.

8 Claims, 3 Drawing Sheets

CENTRALIZED SUMP OIL AND ACID OIL TREATMENT PROCESS AND SYSTEM

BACKGROUND OF THE INVENTION

This invention involves an environmental governance method, a specific centralized sump oil and acid oil treatment process and system.

With an in-depth awareness of the people who have been faced with more and more serious environmental pollution in the world, the cleaning and treatment of sump oil and acid oil of the oilfield attract more and more attentions. The oilfield exploitation brings a great amount of sump oil and acid oil which are difficult to dewater. Such non-standard oil containing water, impurity and high viscosity was sold to the local firing enterprises and refineries at a lower price in the past as the firing oil and non-standard oil. Considering that it is not decomposed and treated, such sump oil and acid oil contain a great amount of harmful chemical compositions and it brings serious pollution and damage to the surroundings of the oilfield and the production equipment. Additionally, the penetrating sour gas volatilized by the acid oil pollutes the air of surroundings. Such odor can be smelled a few kilometers away and it seriously damage the physical health of employees in the oilfield. The acid liquor causes the corrosion to the mechanical equipment. The coils in the oil storage tank and the suction pumps are replaced regularly. In this way, it greatly increases the production cost.

The acid liquor-contained sump oil has strong corrosion, and it easily reacts with the colloid and asphaltine to form the particles in suspension. It hinders the settlement and the alkali cannot be neutralized so that it is difficult to separate the oil and water. Thus, it is a difficult problem for many oilfield experts, for that the acid-contained sump oil has great viscosity and proportion. A large amount of acid water cannot be separated only by the way of settlement. The simple treatment process has no effects on the viscosity and acid oil in the sludge and it has no effects on purification. Therefore, the ideal treatment approach is required for treatment and recovery.

Although there are many patent applications in treating oil sludge and sump oil, for example, the patent application of 200510045971.9, 200710064407.0, 200610046997.x and 200710011114.6 is published with the treatment methods of heavy oil sludge, tank cleaning oil sludge, sewage and crude oil dehydration, yet the proper measures against the sump oil and acid oil are not developed. It also does not encounter the difficulty of oil, water and impurities in the sump oil and acid oil.

BRIEF SUMMARY OF THE INVENTION

In order to solve the recovery treatment difficulty of the sump oil and acid oil, the main purpose of this invention is to provide one effective treatment process of sump oil and acid oil to easily separate the oil, water and impurity in the sump oil and acid oil. Meanwhile, this process simple with low treatment cost.

This invention provides a specialized treatment system in the said way.

The centralized treatment process of sump oil and acid oil, consists of that (1) the sump oil is filtered by the coarse filter for removing the coarse impurities; (2) enters to the reaction kettle; the compressed air is introduced from the coil at the bottom of the reaction kettle with the pore diameter of 60-110 μm and it is stirred after the tiny bubbles are produced; at the same time, the sodium carbonate solution with the weight percentage of 7-18% is added to the sump oil till the PH value of the sump oil keeps about 6.0-8.0; then the emulsion splitter with the volume ratio of 0.4-0.8% is added to the sump oil in the kettle; then the flocculating agent with the volume ratio of 0.1-0.5% is added in the sump oil in the kettle for further reaction. The compressed air is provided for 2.5-3.5 hours; (3) the compressed air is suspended and it is settled for 4-6 hours; (4) the detergent oil at the upper level of the reaction kettle is provided to the purification tank, the detergent oil in the said purification tank is filtered by the fine-mesh filter at the mesh diameter of 1-1000 μm; then it is heated to 110-120° C. and it is dehydrated in the dehydrating tower under common pressure, then it is heated to 70-90° C. by the heat exchanger; then it is delivered to the dehydrating tower under the reduced pressure for dehydration under 20-70 kPa to obtain the national crude oil; the sewage produced after condensation of the water vapor dehydrated by the dehydrating tower under normal and reduced pressure and the intermediate sewage are delivered to the sewage tank. The sewage in the sewage tank is delivered to the vertical natural oil removal tank to separate the oil and water by way of gravity at a flow speed of 0.5-0.8 mm/s. The water outlet is drained after filtering by the oil-water filter; the oil sludge at the upper level is retained in the reaction kettle, and the oil sludge in the reaction kettle is rinsed with the sodium hydroxide solution at a temperature of 65-75° C. and the weight percentage concentration of 10-20% at a proportion of (1.5-2.5):1 for 15-25 min, and settled for above 2.5 hours. The detergent oil after washing with hot water at the upper level is delivered to the purification tank and the intermediate soda solution is collected in the soda solution tank, and the sediment impurities at the bottom of the reaction kettle are delivered to the sludge solidifying tank with the sludge pump.

The acid oil in this invention refers to the acid-contained sump oil.

In this invention, the soda liquor is added when the fine air bubbles and air suspension are made. After full reaction, the demulsifying agent and flocculating agent are added to successfully break the suspended particles in the oil sludge and easily settle and separate the oil and water. In addition, the process is simple with low cost.

Further, the sump oil filtered by the coarse filter to remove the coarse impurities is delivered to the reaction kettle after the oil pump, and the sump oil in the reaction keeps heats to the temperature of 55-70° C. and the said sodium carbonate solution is added in the sump oil so that PH value of the sump oil maintains 6.0-8.0, then the temperature of the sump oil in the kettle increases to 70-90° C., and then the said emulsion splitter and the said flocculating agent are added.

Further, the said emulsion splitter is the non-ionic surface active agent with the trunk chain of polyether, with the terminal base containing hydroxide radical, amino group, ether group and carboxyl. The said flocculating agent has the main composition of polymerized alumina.

Further, the said sodium carbonate solution is delivered to the reaction kettle by the stainless steel magnetic pump for delivery of sodium carbonate solution.

Further, the said fine filter is made by the bag-type fine-mesh filter with the filter precision of 1-1000 μm.

Further, the said oil-water filter consists of the coarse filter tank puddler for coagulation, separation and removal of oil, levitated sphere maze for removal of turbid by microvortex, annular space for removal of dregs and the walnut shell medium for filter and purification.

Further, the said sludge solidifying tank takes the weight of the sludge as the reference, and 6-9% of Portland cement, 2-5% of quicklime and 0.5-2% of alumina are added for the purpose of solidifying the sludge after mechanical stirring.

One central treatment system of sump oil and acid oil, wherein, it consists of the coarse filter for removal of coarse impurities, the oil pump and the reaction kettle for delivery of sump oil, the stainless steel magnetic pump for delivery of acid or alkali solution, purification tank, sewage tank, the bag-type fine-mesh filter with the precision of 1-1000 μm, the dehydration system under normal and reduced pressure, the vertical natural oil removal tank for coagulation, separation and removal of oil, levitated sphere maze for removal of turbid by microvortex, annular space for removal of dregs and the walnut shell medium for filter and purification.

The basket-type filter can be bought from Shandong Xulong Petrochemical Equipment Co., Ltd. HF-B01-LCR LC oil pump from Dandong Yiyang Pump Industry Technology Co., Ltd., HF-01B special sump oil demulsifier from Tianjin Wanfengshun Science Trade Development Co., Ltd, HF-02 flocculating agent from Hebei Huarui Lanxing Chemical Industry Construction Materials Co., Ltd; HF-C01 bag-type fine-mesh filter from Shijiazhuang Baisite Filter Equipment Co., Ltd., and HF-E01 oil-water filter from Yangzhou Xiongdi Environmental Equipment Co., Ltd.

The detailed description of the technical plan of this invention is shown below:

1. Separation of Oil, Water and Impurity:

The reason why to decompose and treat the sump oil and acid oil difficultly is that such oils are placed for long term in an open air with the low light compositions and the water, heavy compositions and sludge of the main compositions. The proportion of sump oil is close to the water and the sump oil itself contains the asphaltine, colloid, naphthenic acid and natural emulsifier enriched on the surface of the oil and water to form the stable interfacial film. At the same time, acted by the microorganism and acid liquor, the asphaltine, colloid and heavy compositions in the sump oil degrades and gathers into a mass. Then the added chemical agent is mixed with the natural emulsifier to make the sump oil difficult to treat. Thus it becomes the multiple phase of crude oil emulsion that small stable oil drops contain water and the water contains the oil drops.

This invention firstly neutralizes and decomposes the residual acid in the sump oil to make PH value maintains at a range of 6-8. After decomposition of residual acid, the emulsifier in the sump oil is diluted and transformed to lower the emulsification ability of the emulsifier, reduce the trnsion of the oil sludge interface, break the balance of the oil ion, and lower the surface strength of the drops so that it is easy to gather into the larger drops.

After heating settlement, the sludge and water in the sump oil can be dehydrated. Then the acid liquor in the acid oil of the sump oil is decomposed so that PH value is neutral. Finally, the sump oil is fully dehydrated under normal and reduced pressure. The study shows that the proper electrolyte is added to increase the charging density of the system at the time of emulsion breaking for the purpose of driving that the oil is separated from the surface of the solid particles of the sludge, so that they can replace the oil compositions and affix on the surface of particles and disperse the particles and it creates better conditions for oil removal from the solid particle surface.

In consideration of high viscosity of the sump oil, serious emulsification, strong adhesive force of particles among solid, solid and liquid and lower density difference, it is determined to adopt the inversed emulsion breaking and electrochemical reaction driving, in addition to the heating to achieve the purpose of removing the sludge and water in the sump oil. The surface active agent and flocculating agent are taken as the chemical agent. The role of the surface active agent is to make the transition of the original emulsion that the water-in-oil emulsion is converted to the oil-in-water emulsion. For that the oil-in-water emulsion has poor stability, the water and sludge is easy to settle; the flocculation refers to a process of coalescence of large particles after stability loss of colloid and impurity (or absorption and bridging of polymer substance). The role of the flocculating agent is to develop the electrochemical reaction so that the colloid and impurity contained in the sump oil after stability loss are formed to the larger particles to remove the small impurities and sludge and develop the emulsion breaking.

The emulsion splitter adopted in this invention is HF-01B special sump oil emulsion spillter, which is the polycomponent non-ion surface active agent generated after action of polyoxyethylene, fatty amidogen ether and several base materials with the trunk chain of polyether structure and with the terminal base containing hydroxy group, amino group, ether group, carboxyl and poly hydrophilic functional groups. It is a kind of agent with sound water solubility. In the sump oil, this agent is added in proportion to lower the oil-water interfacial tension of the sump oil, break the balance of electric potential, change the organic oil soluble salt to water soluble salt, easily gather to large drops. Finally, the compositions of the oil are separated for the purpose of desalting, impurity removing, dehydration and emulsion breaking. The technical indicators of HF-01 emulsion splitter are shown in Table 1 with sound water solubility. When diluting, it is stirred slightly. Within three minutes, it can be dissolved fully. The W/O sump oil with high acid value, paraffin content, water content of 50% and strong hydroscopicity to about 10%. The small quantity of the agent is used with no pollution in a safe and reliable manner.

The commonly-used coagulating agents are aluminium sulphate, ferrous sulfate, ferric trichloride, bodied ferric sulfate and inorganic coagulating agent, polyacrylamide, propylene, 2-propylene 2-amine and organic coagulating agent. This invention has a preference of HF-02 flocculating agent, which is a new high polymer flocculating agent with the main composition of polyaluminium chloride (abbreviation of PAC), chemical structural formula of [Al2(OH)nCl6-n]m, where, $1 \leqq n \leqq 5$, $m<10$ is between AlCL3 and Al(OH)3. The bridging polymerization is made by hydroxyl group. The molecular contains unequal hydroxyl group with strong bridging absorption performance. During hydrolysis, electrochemistry, agglomeration, settlement, absorption, physical change and chemical change take place, characteristically of that (1) the small quantity is used during coagulation; the flocculating constituent is formed quickly; the settlement is made at a high speed; the reaction settlement time is shortened and the treatment ability is improved. (2) more flexible, pH more flexible than AL2(SO4)3 and temperature more flexible than AL2(SO4)3; (3) 5-8 times as good as aluminium sulphate and 3-5 times as good as ferric trichloride, better than ferrous sulfate and alum; (4) no secondary basic accelerator, 30-70% lower than low molecular flocculating agent on the cost; (5) quick solution, low corrosion, removal of iron, manganese, arsenic, fluorine, beryllium and chrome in the source water and good effects on removal of radioactive contamination and organic coloring matter in the water. The indicators are shown in Table 2.

For the said process, this invention adopts the method of air floatation to quick up the chemical reaction, the emulsion breaking and separation of compositions of the sump oil. The air floatation method is an effective method to treat the high water-contained sump oil. The water content in the sump oil of the oil field increases by above 50% and the air floatation method is used to quick up the separation of the compositions of the sump oil. It means that the high-pressure air is introduced to the high-water sump oil to produce a great amount of the tiny bubbles with an average diameter of 80 μm so that the petty oil balls in the sump oil affix on the air bubbles. It floats on the water surface with the air bubbles and it greatly quickens the process of separation and the air bubbles produced by the air floatation play a role of stirring, so that the added agent fully reacts with the sump oil. The specialized stirring equipment is unnecessary, killing two birds with one stone. After stirring and separation by way of air floatation method, the settlement method is adopted to separate any sludge.

The basket-type filter is preferred in this invention and it is a coarse filter to remove large impurities. The basket-type filter is a kind of the advanced and practical filter with thick pipe, large quantity of dirt collection, high pressure withstand, and easy installation and cleaning. It is applicable for filter of large particles in oily water. It is installed on the pipe to remove the large solid impurities in the fluid, so that the production equipment is not blocked and work normally to achieve the stability of process and safeguard the safe production. The basket-type filter in this invention is made of stainless steel mesh grid, characteristically of easy installation, removal, cleaning and strong filter. The production experience shows that it is applicable to remove the large particles of impurities in the sump oil and acid oil.

HF-B01-LCR LC oil pump is preferred as the oil pump for delivery of sump oil in this invention. It is primarily used for delivery of sump oil at the time of loading, unloading and emptying. This oil pump is improved on the basis of HF-LC pump and it adopts the multi-sealing mode to ensure that the oil pump does not leak if it works for long term. The flow rate increases by 200 m3/h to meet the different requirements on flow during production. The drive modes of HF-B01-LCR oil pump are flexible, with two drive ways of reducer and belt. Meanwhile, this pump has low rotate speed, effectively lowering the pulse vibration and noise, high efficiency, saving energies; small in size, reducing the floor area. It can be moved entirely during production, easy maintenance, counter rotation. It has strong self-suction and easy operation without oil with the suction length of 6 m. To deliver the high-viscosity medium, the pump body is designed with the insulation cavity and it is heated with the steam or conduction oil, to ensure the continuous or discontinuous work of the oil pump and normal operation in the cold winter in northern area.

HF-B02-IMC stainless steel magnetic pump is preferred for delivery of acid or alkali solution. It is a new product with the state-of-the-art design after any drive pumps are integrated, primarily used for delivery of acid or alkali solution during production. In accordance with ISO2858, its flowed passage parts are made from the stainless steel. The explosion-proof motor is used and it has sound corrosion resistance to the organic acid, organic compound, alkaline solution, neutral solution and other multiple gases. The double helix carbon graphite bearing is well matched with the hard alloy bearing with strong wearing resistance and service life. It is an ideal pump for leakproof delivery of corrosive medium. It is single-stage single-way suction cantilever type. At the time of delivery of high-temperature medium (the temperature of delivery medium≦400° C.), the water cooler is not used, but the intermediate coupler is installed. For the purpose of repair, the circuits and motors are not disassembled but the intermediate coupler is only disassembled. The specific parameters are as follows: the inlet calibre of 80 mm, outlet calibre of 50 mm, flow of 50 m3/h, pump head of 80 m, motor power of 37 kw, motor speed of 2900 r/min, pressure of 1.6 mpa and temperature of −20° C.-400° C.

2. Detergent Oil Dehydrating

After the residual acid, sludge and water in the oil are removed in the said processes, the detergent oil meets the international standard, but 10%-20% water is still retained. The structure of such water and oil is stable, and it is difficult to separate in a chemical method. In this invention, the physical method and the way of atmospheric and vacuum are adopted to remove the remaining water in the oil. For that the boiling point of the water is different from that of the oil, the water is fully gasified at a temperature of 120° C. under atmospheric conditions. However, the sump oil is placed in an open air for long term. The distillation test shows that no light compositions of the sump oil are shown before the temperature of 120° C. It also represents that the light compositions of C1-C5 in the sump oil have been volatized. Therefore, the co-boiling of water and oil is not produced. Under vacuum station, the boiling point of water is reduced and it can be gasified at low temperature.

The water-bearing oil in the oil cleaning tank is filtered by the fine filter to remove the petty impurities. The test shows that, the bag-type fine filter is most applicable to treatment of the fine filter in the crude oil. HF-CO1 bag-type fine filter is preferred as the bag-type fine filter with the precision of 1-1000 μm. The filter area is 60% more than the standard filter bag in the same size. It is characteristically of high passage, high filter precision, large filter area, strong dirt collection, long replacement cycle of filter bag, sound sealing, easy replacement of filter bag, easy and quick operation. It is applicable to filter of any petty particles (less than 1000 ppm) for the fluid with the precision range of 1-1000 μm and 1-1000 m3/h. HF-C01 bag-type fine filter is a easy, effective and commonly-used fluid filter system, composed of container, bag and support. The detergent oil filtered enters to the filter barrel under the pipeline pressure. After electrolytic polishing for punching, it enters to the filter bag supported by the filter basket to properly separate the solids and fluid so that the detergent oil is fully filtered. Different filter precision depends on the filter bag with different precision. For that the liquid medium is flowed from the top end of the filter bag after the liquid medium enters to the filter, so that the liquid can be evenly distributed at the surface of filter of the whole filter bag and the distribution of the fluid on the whole surface is constant. With less adverse effects of the stirring motion, the solid matters in the liquid are retained in the bag to obtain the clean fluid. The medium has characters of great passage, pressure drop, easy operation and economical rationality.

After the impurities are removed from the detergent oil by fine filter, it enters the heat exchanger for heat exchange and heating. The hot fluid for heat exchange is from the international crude oil under atmospheric and vacuum. HF-D01 shell-and-tube exchanger is preferred in this invention. It is composed of shell, heat-transfer pipe bundle, tube plate, traverse baffle (stop plate) as well as header. It is a dividing wall type heat exchanger with the wall surface of pipe bundle enclosed in the shell as the heat-transfer surface. It has simple structure and reliable operation under high temperature and pressure. It is a commonly-used type. The shell is columnar and the pipe bundles are installed with both ends of the pipe bundles on the pipe plate. The cold and hot fluids for heat exchange are flowed respectively inside and outside the pipe. To improve the individual heat transfer coefficient of the fluid outside the pipe, the numerous stop plates are installed in the shell. The stop plate can improve the speed of fluid and drive the fluid to conduct the transverse passage of pipe bundles for several times as the specific routes and increase the turbulence extent of the fluid.

The temperature of detergent oil after heat exchange by the heat exchanger reaches about 80° C., then it is heated to 120° C. in the atmospheric tubular heater through the pump. The tubular heater is composed of radiation chamber, convection chamber, funnel, waste heat recovery system, burner and ventilation system, etc. The radiation chamber is the core part of the heating furnace, as the hottest part in the entire furnace. 70%-80% of the heat load of the entire furnace is assumed by the radiation chamber. The convection chamber conducts the heat exchange with the fume from the radiation chamber. In the convection chamber, rows of furnace tubes are placed. These pipes are flushed by the fume at a high speed for the purpose of effective heat exchange. The chimney is a passage for fume exhaust. At the same time, control of the discharge of fume is to control the combustion efficiency of the radiation chamber, so as to control the temperature of the radiation chamber, characteristically of high temperature (flame temperature of 1000-1600° C.), large heat transfer capacity (heat transfer intensity of furnace pipe of 330000 kj/m2 h). The heating furnace takes the natural gas in the oilfield or the coal gas produced from the coal gas generator as the fuel to generate the high-temperature flame and fume. With the furnace pipe wall, the crude oil flowed in the furnace pipe is heated to meet the temperature needed.

After the detergent oil is heated to 120° C. in the atmospheric heating furnace, it is dewatered in the atmospheric dehydration tower. After the oil enters to the atmospheric tower, the water molecule contained is vaporized immediately. The crude oil in the tower flows to the tower bottom along the tower plate to the heat exchanger for heat exchange of untreated detergent oil. In the atmospheric tower, many tower plates are installed for the purpose of heat transfer and medium transfer during dehydration and provision of contact of gas and liquid. The tower plate makes the evenness of flow from above to below, increases the contact area of steam and liquid, lengthens the time of flow, fully removes the water in the crude oil. After the atmospheric tower and heat exchanger, the detergent oil's temperature falls to about 80° C. and its water-bearing rate falls to about 5%. The next step is to realize the full dehydration after vacuum tower.

After the detergent oil is dewatered in the atmospheric tower and the heat exchange is made in the heat exchanger, its pressure keeps between 0.2-0.3 MPa. After it is delivered to the vacuum tower by the oil pump, the pressure is reduced till full dehydration in principle that the boiling point reduces when the pressure of the liquid is lower than under atmospheric conditions. At the top of the vacuum tower, the vacuum compressor is installed for suction to keep the vacuum of the flash tower at about 20-70 kPa. After the detergent oil at a temperature of 80° C. enters to the vacuum tower, the oil will boil immediately under vacuum of the tower, and the water molecule is gasified to be the water vapor and it is suctioned to the vacuum tower by the vacuum compressor at the top of the tower. The pressure increases to 0.2-0.3 MPa by the compressor, then it is condensed to the water at a temperature of 40° C. by the condenser, and it is delivered to the water storage tank for further purification. For that the vacuum dehydration tower works under vacuum, the tower bottom is uplifted to the proper height so that the crude oil at the tower bottom is pumped out by the oil pump successfully. The oil pump is located at the tower bottom as close as possible, to lower the resistance loss of source pipes. The position difference between the tower bottom liquid level and pump entry depends on the vacuum, generally 5-10 m. The temperature of international crude oil after full dehydration in the vacuum tower falls to 60° C.-70° C. It is directly delivered to the oil tank for storage without heat exchange.

The cleaned water has the water-bearing rate less than 0.2% after the dehydration by the said atmospheric and vacuum dehydration system. It can be directly transferred to the refinery until all indicators after test fully meet the standards of the international crude oil.

3. Sewage Purification

A little sump oil and some suspended impurities are contained in the sewage that sump oil decomposition produces, and in the condensation water that detergent oil under the normal/reduced pressure produces. Such a sewage will directly pollute water source and stratum if it is discharged or flooded underground. So it must be clarified to reach the standard.

For this invention, the sewage concerned is input to vertical oil removal tank. With gravity separation method, oil and water are separated by their density difference. The sewage in the tank stays for 3 hours, with dropping flow rate 0.5-0.8 mm/s, inflow water oil content 1000 mg/L, effluent oil content less than 200 mg/L, and oil removal efficiency 80%. For inflow suspended matter 300 mg/L, effluent suspended matter is less than 240 mg/L, and suspension removal rate of 20%. In this way, the sewage with larger particles and floating sewage after being stilled, so that continuous phase oil slick can surface. When surface oil is thick, suction pump can be applied to transfer it to sewage tank for re-purification. The sediment is drained to kettle by outlet at bottom of the tank for chemical thermal washing with aqueous alkali, solidified with other sewage at last.

The sewage being purified by vertical tank has very low oil content rate and impurity rate, so it's not necessary to gradually clarify it with other complicated methods. Filtering it in oil-water filter can completely remove the sewage and all impurity in water, so that the sewage can reach national standard for purified water.

HF-E01 oil filter is selected, consisted by filtering tank of thick and thin two levels based on coagulation dynamics and micro-vortex principles. Pressurized by lift pump, the sewage enters thick filtration tank for oil removal. The treated sewage flows in micro-suspension enclosure for purification with micro-vortex, then in ring space for gravity settling and slag separation. After that, the water flows in filter cartridge sidewise, with fine particle and oil droplets retained by filter medium nutshell. The designed removal rate for oil and suspension is more than 80%. The sump oil separated outflows from upper oil tube, and impurities are discharged from lower blow-off pipe. Being filtered, the water is drained from center outlet pipework. Flowing in, filtering and discharging is operated simultaneously. For conventional wastewater or sewage, washing desorption can achieve the same desired effect. This device carries the advantage of water treatment equipments in domestic and abroad, integrating vortex coagulation separation with micro vortex decontamination, levitated sphere oil removing, walnut shell filtration and purification, filtering media filling by pump, and cycle medium washing and regeneration etc. The device is multifunctional and multi-level, separating oil and water while isolating liquid and solid, featured by high capacity, high filtration precision, continuous discharge of sewage and oil, easy regeneration, simple operation, and safe reliable running etc. For detailed data, see Table 3. Being tested, the sewage filtered by this device completely complies with the standard specified in Recommended Indicators and Analysis Methods for Water Quality of Clastic Rocks Oil Deposit SY-T5329-94, and GB8978-88 national comprehensive standard on exterior drainage. Standardized, the water can be directly discharged or flooded underground.

4. Sludge Solidification

Sediment impurities from the said process contain about 15% crude oil through the chemical laboratory analysis, which is separated with the chemical thermal washing method. This method can decrease oil residual rate to less than 0.5%. The recycled alkali can be used repeatedly, conforming to national environmental requirement.

Being analyzed, the sludge chemically washed contains less than 0.5% residual oil, and about 40% water. The mineral components of the sludge: 95% calcite, 1% anhydrite, 1% quartz, 2% rock salt and 1% potash feldspar. Measured by wet sieving device, the grain diameter of mud particle is between 180-200 meshes. For this invention, cement based solidifying, quicklime and alumina coagulant aid method can be applied to make final consolidation. 425#common silicate cement whose ingredients are dicalcium silicate and tricalcium silicate is appled in the curing agent to make a hydration reaction after mixing with sludge to form hydraulic materials, mainly including tobermorite and ettringite, to be up to the effect of sludge consolidation. At the same time, hydration products can stabilize and seal pollutants to reduce environment pollution. Coagulant aid contains calcined lime and alumina, which have hydration reaction with cement during consolidation process, reduce cement volume, promote coagulation, enhance intensity of curing block, and increase the absorption of harmful substances. Quicklime and alumina produce hydration reaction with cement, generating calcium hydroxide, aluminum hydroxide and other non-water-soluble substances that can absorb and precipitate a large number of heavy metals and other toxic hazardous substances and reduce leaching rate of hazardous substances so as to detoxify. Quick lime can also be used to sterilize for sludge for better hazard-free treatment.

For the new method of final solidification treatment, cement-based solidification, quick lime and alumina coagulant aid have the following advantages: (1) during sludge treatment process, less curing agent and coagulant aid is used for better solidification effect, lowering sludge volume after solidified, sterilize pathogenic bacteria and parasite (ovum) in sludge; (2) being solidified, it can avoid the loss of harmful substance in heavy metals to prevent secondary pollution; (3) the solidified sludge changes mobility, with low volume, high compression resisting strength and immersion resisting capability, and lower leaching toxicity, maintaining solid formation and stable chemical properties for long-term, keeping good stability after being soaked in water, acid and alkali while the heavy metals in sludge will be reserved to weaken mosquitoes-prone environment; (4) the solidified sludge can be used as road material, building materials, or landfill cover soil, which improves its economic value and realizes resource utilization.

The beneficial effects of this invention are as follows:

1. The waste oil and acid oil centralized processing solves the problem of difficult separation of oil, water and impurities in waste oil and acid oil. After the centralized processing, there is no sewage, sludge and sewage oil discharge, which substantially reduces the pollution to surrounding environment and corrosion to equipment. Oil tank is kept clean for long-term, without being desilted, which reduces the expense on cleaning and staffing.

2. The centralized processing turns waste into wealth, recycling a large number of crude oil, reducing production cost of crude oil. The solidified sludge can also be directly used as building materials.

3. The invention greatly enhances economic benefits of oil field. The waste oil and acid oil being processed reaches national standard. The recycled GB crude oil account for more than 70% of waste oil. By current list price of GB crude oil, it can increase income for tens of millions Yuan each year, and enhance crude oil production.

Other advantages, objectives and features of this invention will be explained in the following specifications to some extent, which are obvious for the technical staff in this domain based on the following study, or presented in the practice of this invention. The object and other advantages of this product can be realized and obtained by the following instruction book, claim of right and the structure specially pointed out in figure.

DETAILED DESCRIPTION OF THE INVENTION

Figure 1:
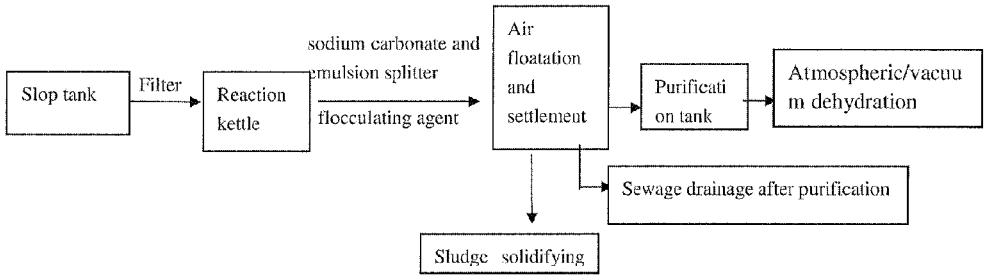
FIG. 1 Flow chart for sump oil and acid oil processing.
Figure 2:
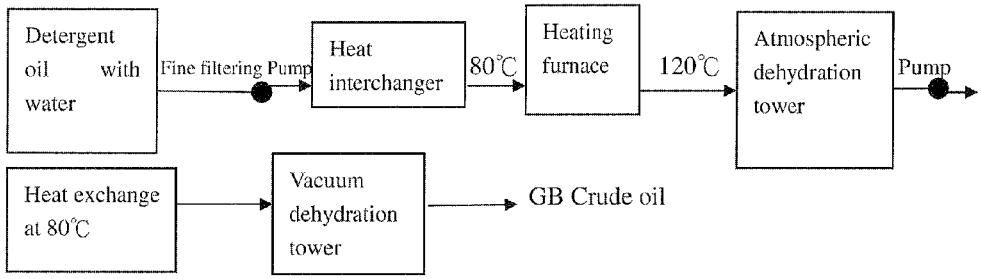
FIG. 2 Flow chart for oil purification and atmospheric and vacuum dehydration.
Figure 3:
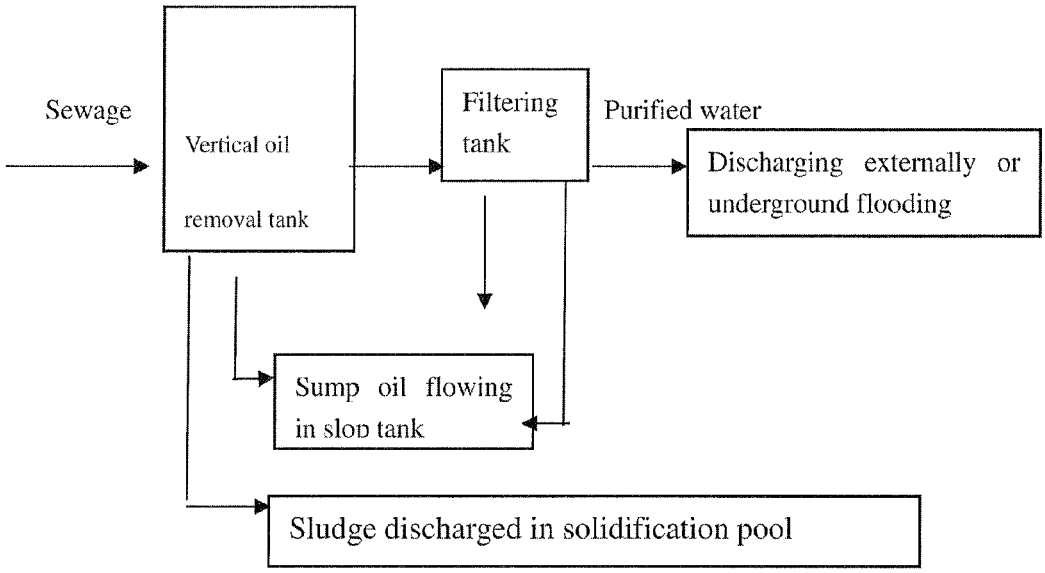
FIG. 3 Flow chart for sewage purification processing.
Figure 4:
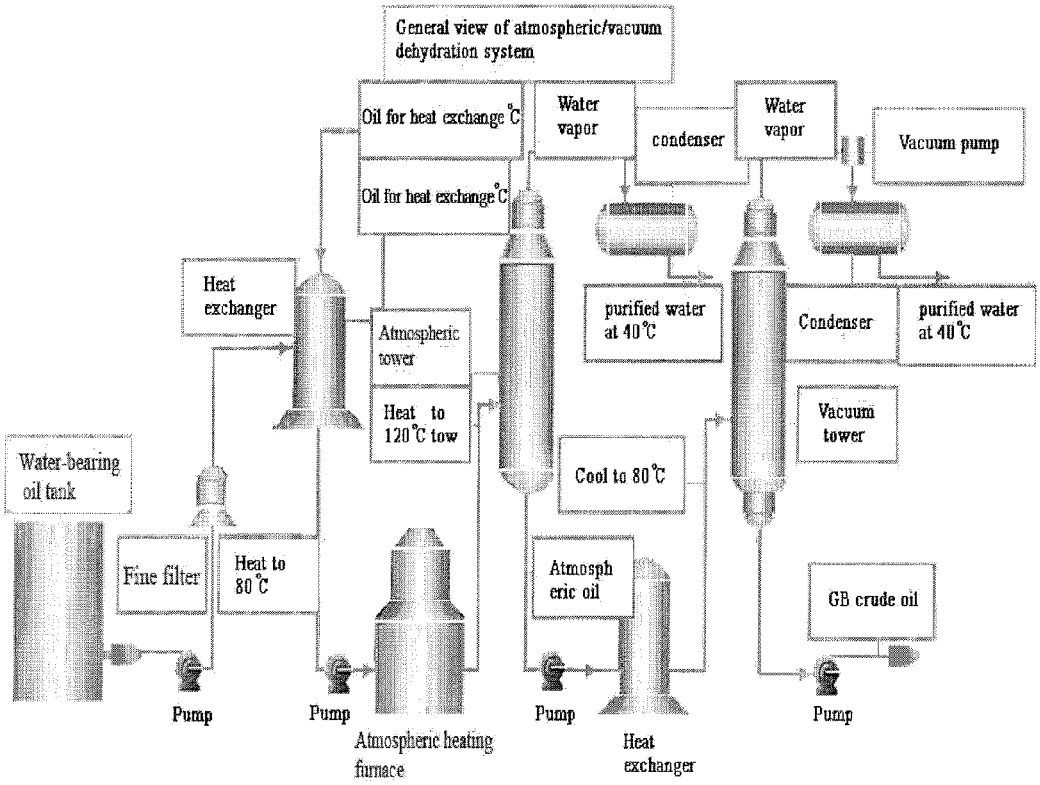
FIG. 4 Flow chart for atmospheric and vacuum dehydration system.

With the following figures, the preference examples are described in detail.

EXAMPLE 1

X-ray diffractometer analyzes that in the waste oil and acid oil of Jidong Oilfield, the content of large particle impurity is about 1%-2%. Fine sediment and other impurities account for about 15%-20%, water content 50%-60%, and pure oil 20-30%. Basket-type filter is used to initially filter sediment impurities of larger volume. The waste oil filtered is poured into kettle for separation of silt, oil and water. Compressed air is injected from the coiler of hole diameter 80 μm at the bottom of kettle, generating fine bubble of diameter about 80 μm for mixture. Add 10% thickness sodium carbonate solution in waste oil to stabilize PH value at 7.2, then put in PR-02 demulsifier of 0.6% of waste oil volume in the tank, and flocculant PFS to react continuously. The lasting time of injecting compressed air is 3 hours. Then stop injecting, still to precipitate for 5 hours, input the purification oil at upper kettle to purification tank, the sewage at middle is discharged in caustic tank while upper sludge is left in kettle.

EXAMPLE 2

Basket-type filter is used to initially filter sediment impurities with a larger volume. The waste oil filtered is poured into kettle by "HF-B01-LCR lobe oil pump. When the oil in kettle is heated to 60° C., compressed air is injected from the coiler of hole diameter 90 μm at the bottom of kettle, generating fine bubble of diameter about 90 μm for mixture. Add 15% thickness sodium carbonate solution in waste oil to stabilize PH value at 7.5. When the temperature in kettle is increased to 80° C., add PR-02 demulsifier of 0.7% of waste oil volume in the kettle, and HF-02 type flocculant of 0.4% of waste oil volume in the kettle. The lasting time of injecting compressed air is 3.5 hours. Then stop injecting, still to precipitate for 6 hours, input the purification oil at upper kettle to purification tank, the sewage at middle is discharged in caustic tank while upper sludge is left in kettle.

TABLE 1

Specifications of HF-01 demulsifier

| No. | Item | HF-01A | HF-01B |
|---|---|---|---|
| 1 | Appearance | Yellow or light yellow viscous liquid | |
| 2 | Hydroxyl value [mgkoH/g]≦ | 45~56 | 56 |
| 3 | Crystallization point [° C.] | −15~−25 | −18~−22 |
| 4 | Chroma No.≦ | 800 | 1000 |

TABLE 2

Specific indicators of HF-02 flocculant

| Name | Index |
|---|---|
| Appearance | Light gray liquid |
| Relative density (20° C.) g/cm3 | ≧1.19 |
| Alumina % | ≧10.0 |
| Basicity % | 50.0~85.0 |
| PH value (1% aqueous solution) | 3.5~5.0 |
| Water insoluble matter % | ≦0.5 |

EXAMPLE 3

Basket-type filter is used to filter waste oil. The waste oil filtered is poured into kettle by "HF-B01-LCR lobe oil pump. When the oil in kettle is heated to 50° C., compressed air is injected from the coiler of hole diameter 60 μm at the bottom of kettle, generating fine bubble of diameter about 60 μm for mixture. Add 7% thickness sodium carbonate solution in waste oil with HF-B02-IMC stainless steel magnetic clutch to stabilize PH value at 6.0. When the temperature in kettle is increased to 70° C., add HF-01B demulsifier of 0.8% of waste oil volume in the kettle, and HF-02 type flocculant of 0.2% of waste oil volume in the kettle. The lasting time of injecting compressed air is 2.5 hours. Then stop injecting, still to precipitate for 6 hours, input the purification oil at upper kettle to purification tank, the sewage at middle is discharged in caustic tank while upper sludge is left in kettle.

EXAMPLE 4

The implementation method is basically the same with Example 1. The difference is that the purified oil in the tank is filtered by HF-C01 bag-type fine filter of bore diameter 1000 μm, heated to 120° C., dehydrated in the dehydration tower, heated to 80° C. by heat exchanger, put in the vacuum dehydration tower to be dehydrated at 70 kPa for GB crude oil. The water vapor extracted from the said atmospheric/vacuum dehydration tower forms sewage after condensed, and then enters the sewage tank.

EXAMPLE 5

The implementation method is basically the same with Example 1. The difference is that the sewage in the tank is discharged in vertical natural oil removal tank, with falling speed 0.7 mm/s. Being filtered by HF-E01 oil filter, the effluent is used for underground flooding.

TABLE 3

Specific data for HF-E01 oil filter

| Item | Index |
|---|---|
| Capacity ($m^3$/h) | 60 |
| Working pressure(MPa) | ≦1.0 |
| Operating temperature (° C.) | ≦80 |
| Filtration rate(m/h) | ≧40 |
| Backwash cycle(h) | ≧24 |
| Backwashing strength(l/s · $m^2$) | ≦4.0 |
| Backwash water($m^3/m^2$ · d) | ≦3.0 |
| Content of influent suspension (mg/L) | ≦30 |
| Content of influent oil(mg/L) | ≦60 |
| Content of suspension filtered(mg/L) | ≦2 |
| Content of oil filtered(mg/L) | ≦10 |
| Particle volume of diameter less than 2 μm after filtration | ≧85% |

Being tested, the sewage filtered by this device completely complies with the standard specified in recommended indicators and analysis methods for water quality of clastic rocks oil deposit SY-T5329-94, and GB8978-88 national comprehensive standard on exterior drainage. Standardized, the water can be directly discharged.

EXAMPLE 6

The implementation method is basically the same with Example 1. The difference is that the 15% sodium hydroxide aqueous solution at 70° C. is washed for 20 min by solid-to-liquid ratio 2:1, and then precipitated for 3 hours. The clarified oil washed from upper surface is put in clarified oil tank. The alkali liquor at middle-level is recycled in alkali tank. Silt impurities at the bottom of kettle are transferred in mud solidifying pool with mud pump.

EXAMPLE 7

The implementation method is basically the same with Example 6. The difference is that based on the mud weight in solidifying pool, add 8% silicate cement, 3% quick lime and 1% alumina, which is mixed evenly with mechanical mixer and maintained for 15 days to form the solidified sludge of compressive strength 4380 KN/m2 for road construction and building materials.

For reference to some optimized examples clearly specified in this invention, the ordinary technicians in this field should understand that it can be changed in various forms and details, without deviating from the spirit and scope defined by claim of right.

What is claimed is:

1. A centralized treatment process of an acid containing sump oil is characterized by:

Step (1): filter the sump oil by a coarse filter for removing coarse impurities to obtain filtered sump oil;

Step (2): input the filtered sump oil to a reaction kettle; compressed air is introduced from a coil at bottom of the reaction kettle with a pore diameter of 60-110 μm and it is stirred after tiny bubbles are produced; at the same time, a sodium carbonate solution with a weight percentage of 7-18% is added to the filtered sump oil till PH value of the filtered sump oil keeps about 6.0-8.0; then an emulsion splitter with a volume ratio of 0.4-0.8% is added to the filtered sump oil in the reaction kettle; then a flocculating agent with a volume ratio of 0.1-0.5% is added in the filtered sump oil in the reaction kettle for further reaction; the compressed air is provided for 2.5-3.5 hours;

Step (3): the compressed air is suspended and the filtered sump oil is settled for 4-6 hours;

Step (4): provide detergent oil at upper level of the reaction kettle to a purification tank, the detergent oil in the said purification tank is filtered by a fine-mesh filter at a mesh diameter of 1-1000 μm; then it is heated to 110-120° C. and it is dehydrated in a dehydrating tower under common pressure, then the filtered detergent oil is heated to 70-90° C. by a heat exchanger; then it is delivered to the dehydrating tower under a reduced pressure for dehydration under 20-70 kPa to obtain national crude oil; sewage produced after condensation of water vapor dehydrated by the dehydrating tower under normal and reduced pressure and intermediate sewage are delivered to a sewage tank; the sewage in the sewage tank is delivered to a vertical natural oil removal tank to separate the oil and water by way of gravity at a flow speed of 0.5-0.8 mm/s; a water outlet is drained after filtering by a oil-water filter, oil sludge at upper level is retained in the reaction kettle, and oil sludge in the reaction kettle is rinsed with a sodium hydroxide solution at a temperature of 65-75° C. and a weight percentage concentration of 10-20% at a proportion of (1.5-2.5):1 for 15-25 min, and settled for above 2.5 hours; detergent oil after washing with hot water at upper level is delivered to the purification tank and intermediate soda solution is collected in a soda solution tank, and sediment impurities at bottom of the reaction kettle are delivered to a sludge solidifying tank with a sludge pump.

2. The said centralized treatment process of an acid containing sump oil contained as per claim 1 is characterized by: the filtered sump oil filtered by the coarse filter to remove the coarse impurities is delivered to the reaction kettle via an oil pump, and the filtered sump oil in the reaction kettle keeps heats to the temperature of 55-70° C. and the said sodium carbonate solution is added in the filtered sump oil so that PH value of the filtered sump oil maintains at 6.0-8.0, then temperature of the filtered sump oil in the reaction kettle increases to 70-90° C., and then the said emulsion splitter and the said flocculating agent are added.

3. The centralized treatment process as per claim 1 or 2 is characterized by: the said emulsion splitter is a non-ionic surface active agent with a trunk chain of polyether, with terminal base containing hydroxide radical, amino group, ether group and carboxyl; the said flocculating agent has a main composition of polymerized alumina.

4. The centralized treatment process as per claim 1 is characterized by: the said sodium carbonate solution is delivered to the reaction kettle by a stainless steel magnetic pump for delivery of sodium carbonate solution.

5. The centralized treatment process of an acid containing sump oil as per claim 1 is characterized by: the said fine-mesh filter is made by a bag-type fine-mesh filter with a filter precision of 1-1000 μm.

6. The centralized treatment process of an acid containing sump oil as per claim 1 is characterized by: the said oil-water filter consists of a coarse filter tank puddler for coagulation, separation and removal of oil, a levitated sphere maze for removal of turbid by microvortex, an annular space for removal of dregs and a walnut shell medium for filter and purification.

7. The centralized treatment process of an acid containing sump oil as per claim 1 is characterized by: the said sludge solidifying tank takes weight of the sludge as reference, and 6-9% of Portland cement, 2-5% of quicklime and 0.5-2% of alumina are added for the purpose of solidifying the sludge after mechanical stirring.

8. A centralized treatment system of an acid containing sump oil is characterized by: it consists of a coarse filter for removal of coarse impurities in the sump oil to obtain filtered sump oil, an oil pump to deliver the filtered sump oil and a reaction kettle for receiving the filtered sump oil, a stainless steel magnetic pump for delivery of acid or alkali solution into the filtered sump oil in the reaction kettle for neutralization and decomposition of residual acid in the filtered sump oil, a purification tank for receiving detergent oil obtained at an upper level of the reaction kettle, a bag-type fine-mesh filter with a precision of 1-1000 μm to filter the detergent oil in the purification tank to obtain filtered detergent oil, a dehydration system under normal and reduced pressure to dehydrate the filtered detergent oil, a sewage tank for receiving sewage produced by the dehydration system, a vertical natural oil removal tank to receive the sewage in the sewage tank for coagulation, separation and removal of oil in the sewage, and an oil-water filter which receives the sewage after the sewage is treated by the vertical natural oil removal tank, wherein the oil-water filter consist of a levitated sphere maze for removal of turbid by microvortex, an annular space for removal of dregs and a walnut shell medium for filter and purification.

* * * * *